US005308378A

United States Patent [19]

Evans et al.

[11] Patent Number: 5,308,378

[45] Date of Patent: May 3, 1994

[54] SURFACE PASSIFICATION OF A GROUP IVB METAL SPONGE REGULUS

[75] Inventors: Steven C. Evans; Dayle R. Flynn, both of Ogden; R. James Adams, West Point, all of Utah

[73] Assignee: Westinghouse Electric Corp., Pittsburgh, Pa.

[21] Appl. No.: 23,034

[22] Filed: Feb. 24, 1993

[51] Int. Cl.[5] ..... C22B 34/14

[52] U.S. Cl. ..... 75/611; 75/618

[58] Field of Search ..... 75/618, 611

[56] References Cited

U.S. PATENT DOCUMENTS

| | | | |
|---|---|---|---|
| 4,329,168 | 5/1982 | Rubio | 75/711 |
| 4,659,377 | 4/1987 | Foerster | 75/600 |
| 5,062,887 | 11/1991 | Abodishish et al. | 75/425 |
| 5,078,789 | 1/1992 | Abodishish et al. | 75/611 |
| 5,080,859 | 1/1992 | Abodishish et al. | 419/62 |
| 5,100,465 | 3/1992 | Abodishish et al. | 75/618 |

*Primary Examiner*—Peter D. Rosenberg
*Attorney, Agent, or Firm*—J. C. Valentine

[57] ABSTRACT

A zirconium sponge regulus from a Kroll reduction process is contaminated with zirconium chlorides, unreacted magnesium and magnesium chloride. The sponge regulus is vacuum distilled at a temperature of at least 800° C. and then cooled. Before opening the distillation vessel and exposing the sponge regulus to the atmosphere, the vessel is backfilled with a gas comprising 25% to 75%, by volume, carbon dioxide, carbon monoxide or mixtures thereof, with the balance an inert gas and impurities associated therewith.

The sponge regulus is less susceptible to fires when exposed to the air or crushing in downstream processing, and the metal surfaces of the sponge regulus are passivated whereby the overall contamination of the sponge is significantly reduced.

3 Claims, 1 Drawing Sheet

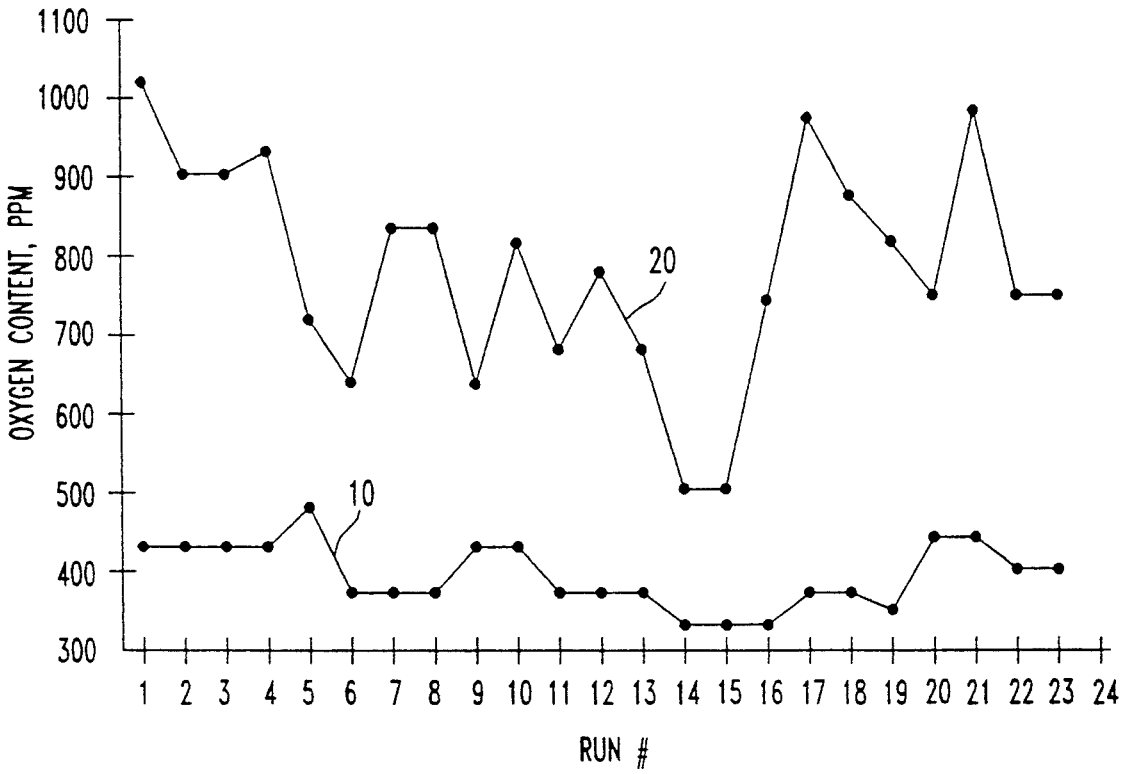
1100
1000
900
800
700
600
500
400
300
OXYGEN CONTENT, PPM
20
10
1 2 3 4 5 6 7 8 9 10 11 12 13 14 15 16 17 18 19 20 21 22 23 24
RUN #

SURFACE PASSIFICATION OF A GROUP IVB METAL SPONGE REGULUS

BACKGROUND OF THE INVENTION

The present invention relates to a method of passifying the surface of a reactive metal sponge regulus.

Reactive metals of Group IVB, including zirconium, hafnium and titanium, are industrially produced from suitable ores by carbochlorination of the ores at high temperatures to produce a tetrachloride powder. The tetrachloride powder is then reduced with magnesium, calcium, sodium or other like metal to form a metal sponge regulus. The sponge regulus is then vacuum distilled at high temperatures to remove the contaminants and subsequently crushed to small particles suitable for further processing.

Reactive metals are highly pyrophoric as are some of the contaminants in the sponge regulus. Thus, a high surface area sponge regulus is subject to fires upon exposure of the distilled sponge regulus to the atmosphere or during the crushing step after the vacuum distillation step. In addition, chemistry specifications for commercial products severely limit the maximum permitted contamination of oxygen and nitrogen, which are present in the air and readily react with these metals. If the metal contains excessive amounts of oxygen or nitrogen, the metal must be recycled. See, in this regard, U.S. Pat. Nos. 5,062,887; 5,078,789; 5,080,858 and 5,100,465 which disclose processes and equipment for vacuum distilling and subsequently handling zirconium sponge.

SUMMARY OF THE INVENTION

It is an object of the present invention to provide a method of passifying the surfaces of a reactive metal sponge regulus from a vacuum distillation step before the sponge regulus is exposed to the air in order to reduce the susceptibility of the sponge regulus to fires. It is another object of the present invention to reduce the overall contamination of the sponges due to atmospheric exposure.

With these objects in view, the present invention relates to an improved method for passivating the surface of a Group IVB metal sponge regulus. In the practice of the present invention, a reactive metal regulus contaminated with unreacted reductant metal, reductant metal chloride and reactive metal chloride is vacuum distilled in a distillation vessel at a temperature greater than about 800° C. to vaporize these contaminants. Following distillation, the distilled sponge regulus in the distillation vessel is cooled. Before opening the distillation vessel to the atmosphere and exposing the sponge regulus to oxygen and nitrogen, the distillation vessel is backfilled with a gas comprising from 25% to 75%, by volume, of carbon dioxide, carbon monoxide or mixtures thereof and the balance an inert gas and impurities associated therewith. The inert gas is preferably helium, argon or mixtures thereof. In a preferred practice of the present invention, the sponge regulus is backfilled with gas while the sponge is cooling.

Advantageously, the reactive metal surfaces processed in accordance with the improved practice become passified and unreactive to nitrogen and oxygen in the atmosphere. The carbon dioxide and carbon monoxide relieve the high surface energy of the highly reactive surface without chemically bonding with the reactive metal. The passivation is manifest through the reduction of fires during handling and subsequent crushing of the sponge for further use. In addition, bulk analysis of crushed sponge particles processed in accordance with the improved practice indicates that overall contamination of the sponge particles is significantly reduced.

DESCRIPTION OF THE DRAWING

The invention will become more apparent from the following description of a preferred practice thereof, presented by way of example only, and the accompanying graphical comparison of the oxygen content of reguli processed in accordance with the present invention and the oxygen content of reguli processed in accordance with the prior art.

DESCRIPTION OF A PREFERRED PRACTICE

In a preferred practice of the present invention in a Kroll process, zirconium tetrachloride is reduced by magnesium to form a zirconium sponge regulus contaminated with zirconium chloride, magnesium chloride and unreacted magnesium. In other practices, zirconium tetrachloride may be reduced with sodium, calcium or other suitable metal. Also, other Group IVB metals such as titanium and hafnium may be similarly processed.

The zirconium sponge regulus is then vacuum distilled in a distillation vessel to vaporize and remove the contaminants. A typical distillation cycle may comprise the following sequential steps, all of which may be performed at 50 microns Hg. First, free moisture is removed by heating the sponge to about 350° C. for about ten hours and the water of hydration is removed by heating the sponge to about 450° C. for about ten hours at 50 microns Hg. The temperature is maintained at least about 800° C. for about twelve to twenty-four hours to vaporize the reductant metal in the sponge regulus. The temperature is then maintained at about 900° C. or more for about twelve hours to vaporize the chlorides. Finally, the sponge regulus may be maintained above about 1000° C. for about ten hours to resinter loose sponge metal particles. The above-mentioned U.S. Pat. Nos. 5,062,887 and 5,100,465 discloses similar zirconium distillation processes.

The distilled sponge in the distillation vessel is then cooled from about 800° C. or higher and the vessel is backfilled with a gas comprising from 25% to 75% by volume carbon dioxide, carbon monoxide or mixtures thereof and the balance an inert gas and impurities associated therewith. As is discussed in U.S. Pat. No. 5,100,465, the sponge may be cooled with the backfilled gas in some practices. In other practices, the sponge may be cooled under full vacuum. In addition, the inert gas may be helium, argon or mixtures thereof.

After the sponge has been cooled to below about 300° C. and the distillation vessel has been backfilled with gas, the vessel may be opened and the sponge exposed to the atmosphere. The sponge may then be crushed in air in the next step in the process and then further processed.

It has been found that distilled zirconium sponge reguli processed in accordance with the present invention are less susceptible to fires during handling and crushing. Also, bulk analysis indicates that overall contamination of the crushed particles is significantly reduced. Thus, for example, multiple electron beam melted (to remove iron only) laboratory samples of twenty-three distilled sponge reguli were processed in accordance with the present invention by cooling the samples with an inert gas containing from 25% to 75% $CO_2$. Multiple vacuum arc-melted laboratory samples from the same twenty-three heats were processed in accordance with the above-described prior art practices wherein the samples were cooled and then exposed to the atmosphere. The oxygen concentrations in parts per million were then determined for the samples, averaged and plotted on the accompanying graph. Line 10 of the accompanying graph shows the oxygen concentrations of the $CO_2$ conditioned samples which were processed in accordance with the present invention. Line 20 shows the oxygen concentrations of the samples which were processed in accordance with the prior art practices. As the graph shows, the average oxygen content of the samples processed in accordance with the present invention contained at least 100 parts per million less oxygen than did the samples processed in accordance with the prior art in each of the twenty three comparisons. Also, the $CO_2$ conditioned samples generally had oxygen concentrations which varied between about 350 and about 450 parts per million whereas the samples processed in accordance with the prior art had oxygen concentrations which varied between about 650 and about 1000 parts per million.

While the present invention has been described with specific reference to a practice presently contemplated to be the best mode of practicing the invention, it is to be understood that various changes may be made in adapting the invention to other practices without departing from the broader inventive concepts disclosed herein and comprehended by the following claims.

We claim:

1. A process for passifying the surface of a Group IVB metal sponge regulus, comprising the steps of:

cooling a Group IVB metal sponge regulus in a vessel under vacuum from a temperature of at least about 800° C.; and backfilling the vessel containing the sponge with a gas containing from 25% to 75%, by volume, of a gas selected from the group carbon dioxide, carbon monoxide and mixtures thereof, and the balance an inert gas and impurities associated therewith before opening the vessel to the atmosphere.

2. The process of claim 1, wherein the Group IVB metal is zirconium.

3. The process of claim 1, wherein the inert gas is selected from the group helium, argon and mixtures thereof.

* * * * *